US007642441B2

(12) United States Patent
Cohen

(10) Patent No.: US 7,642,441 B2
(45) Date of Patent: Jan. 5, 2010

(54) SELECTIVELY TUNABLE PERCUSSION INSTRUMENT

(76) Inventor: Wayne Cohen, 43/40 Baan Phraram 4, Soi Phraya Piren, Rama IV RD, Thungmahamek, Sathorn, Bangkok (TH) 10120

( * ) Notice: Subject to any disclaimer, the term of this patent is extended or adjusted under 35 U.S.C. 154(b) by 0 days.

(21) Appl. No.: 12/106,294

(22) Filed: Apr. 19, 2008

(65) Prior Publication Data

US 2009/0260502 A1 Oct. 22, 2009

(51) Int. Cl.
*G10D 13/02* (2006.01)

(52) U.S. Cl. ..... 84/411 R; 84/413

(58) Field of Classification Search ..... 84/411 R, 84/413

See application file for complete search history.

(56) References Cited

U.S. PATENT DOCUMENTS 6,483,017 B1 * 11/2002 Dill et al. ..... 84/411 R

* cited by examiner

*Primary Examiner*—Jianchun Qin
(74) *Attorney, Agent, or Firm*—LaMorte & Associates

(57) ABSTRACT

A percussion instrument and its method of construction. The percussion instrument has an annular body with an open top and an open bottom. The annular body has multiple sections that include a first section and an opposite second section. The first and second sections join together at bending regions that are located at opposite sides of the annular body. A striking membrane is stretched taut over the open top of the annular body. An adjustment mechanism is provided that is used to selectively bend the annular body within the bending regions. Depending upon what direction the annular body is bent, the tautness of the striking membrane is either increased or decreased. This selectively alters the tone of the sound produced by the drum.

12 Claims, 5 Drawing Sheets

SELECTIVELY TUNABLE PERCUSSION INSTRUMENT

BACKGROUND OF THE INVENTION

1. Field of the Invention

In general, the present invention relates to percussion instruments, such as drums and tambourines, that have a striking membrane pulled taut over an annular support. More particularly, the present invention relates to systems and methods used to selectively adjust the tautness of a striking membrane, therein enabling the tone of the percussion instrument to be adjusted.

2. Prior Art Description

The drum is one of the earliest instruments invented and has been in existence for thousands of years. A drum consists of a striking membrane that is pulled taut over a resonance chamber. When the impact membrane is struck, it vibrates and creates a low frequency tone. The tone of a drum depends upon the area of the drum, the materials used to make the drum and the tautness of the striking membrane that is pulled taut to create the drum.

Originally, drums were made by pulling a section of hide taut over a hallowed log or gourd. The hide was pulled taut by the use of strings or cords that were attached to the portions of the hide that overhung the sides of the drum. As the hide stretched, the hide was made taut by tightening the binding cords.

In modern drums, the striking membrane of a drum is usually a thin film of a synthetic material. Although synthetic striking membranes creep far less than do natural membranes, such as leather, modern synthetic striking membranes do stretch over time. Furthermore, modern synthetic striking membranes may also become less taut because of changes in temperature or humidity that cause the drum itself to expand or contract. It is for these reasons that most professional grade percussion instruments, such as drums, tambourines, and bongos contain some mechanism for tightening or loosening the striking membrane.

Most often, the striking membrane is attached to a percussion instrument using a clamping ring. The clamping ring is attached to a plurality of biasing bolts. As the biasing bolts are tightened, the clamping ring stretches the striking membrane, thereby making it more taut.

The use of a clamping ring with multiple adjustment bolts adds significantly to the cost required to manufacture a percussion instrument. Consequently, such adjustment mechanisms tend to only be used on high-end percussion instruments, such as those used by professional musicians. Low-end percussion instruments, such as those used by schools and amateurs, typically do not have the ability to be adjusted in tone by loosening or tightening the striking membrane of the instrument.

A need therefore exists for a simple, low cost device that enables the striking membrane of a percussion instrument to be selectively adjusted. In this manner, the ability to selectively alter the tautness and tone of a striking membrane can be provided to inexpensive percussion instruments. This need is met by the present invention as described and claimed below.

SUMMARY OF THE INVENTION

The present invention is a percussion instrument and its method of construction. The percussion instrument has an annular body with an open top and an open bottom. The annular body has at least two sections, which includes a first section and a mirror opposite second section. The first and second sections join together at bending regions that are located at opposite sides of the annular body.

A striking membrane is stretched taut over the open top of the annular body. When the striking membrane is struck, the annular body acts as a resonance chamber for the vibrations created by the striking membrane. The tone of the sound created by the striking membrane depends largely upon the tautness embodied by the striking membrane.

An adjustment mechanism is provided that is used to selectively bend the annular body within the bending regions. Depending upon what direction the annular body is bent, the tautness of the striking membrane is either increased or decreased. This selectively alters the tone of the sound produced by the drum.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be embodied as many types of percussion instruments, such as drums, tambourines, bongos and the like, the selected exemplary embodiment illustrated is that of a hand drum. A hand drum is a drum that is held in one hand and struck with the free hand. It is similar in form to a tambourine, but does not have the side cymbals associated with a tambourine. The hand drum is selected merely for its simplicity of structure and clarity in illustrating the present invention. It should therefore be understood that the illustrated embodiment of a hand drum is merely exemplary and should not be considered a limitation when interpreting the claims.

Figure 1:
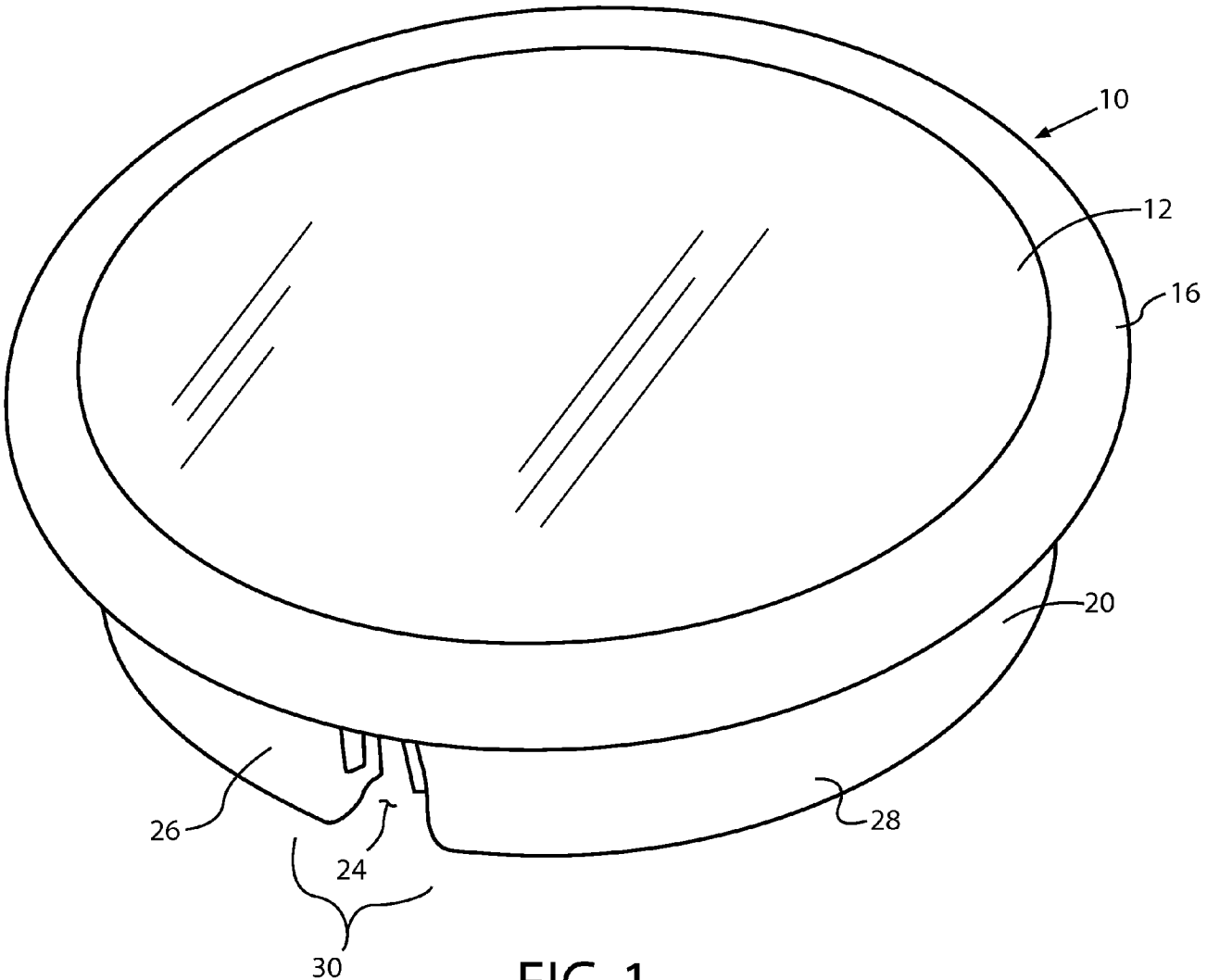
FIG. 1 is a perspective view of an exemplary embodiment of a hand drum assembly.
Figure 2:
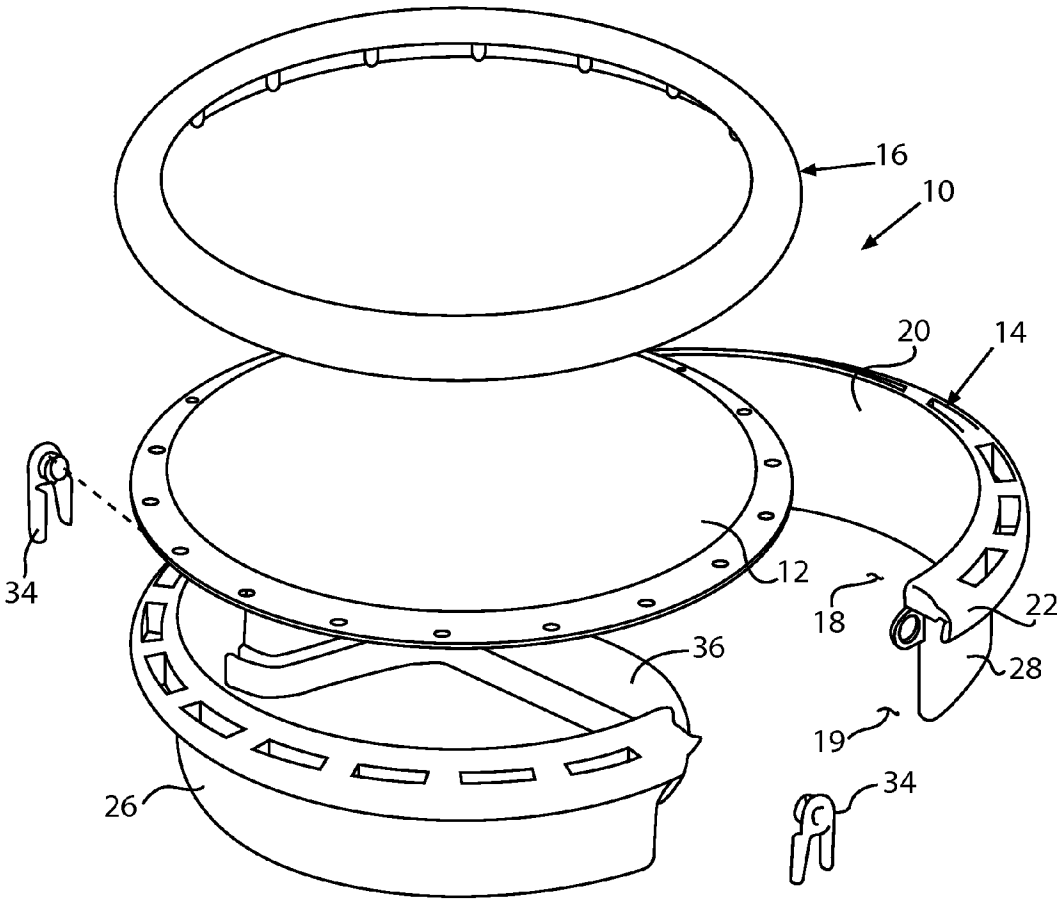
FIG. 2 is an exploded view of the embodiment of FIG. 1.
Figure 3:
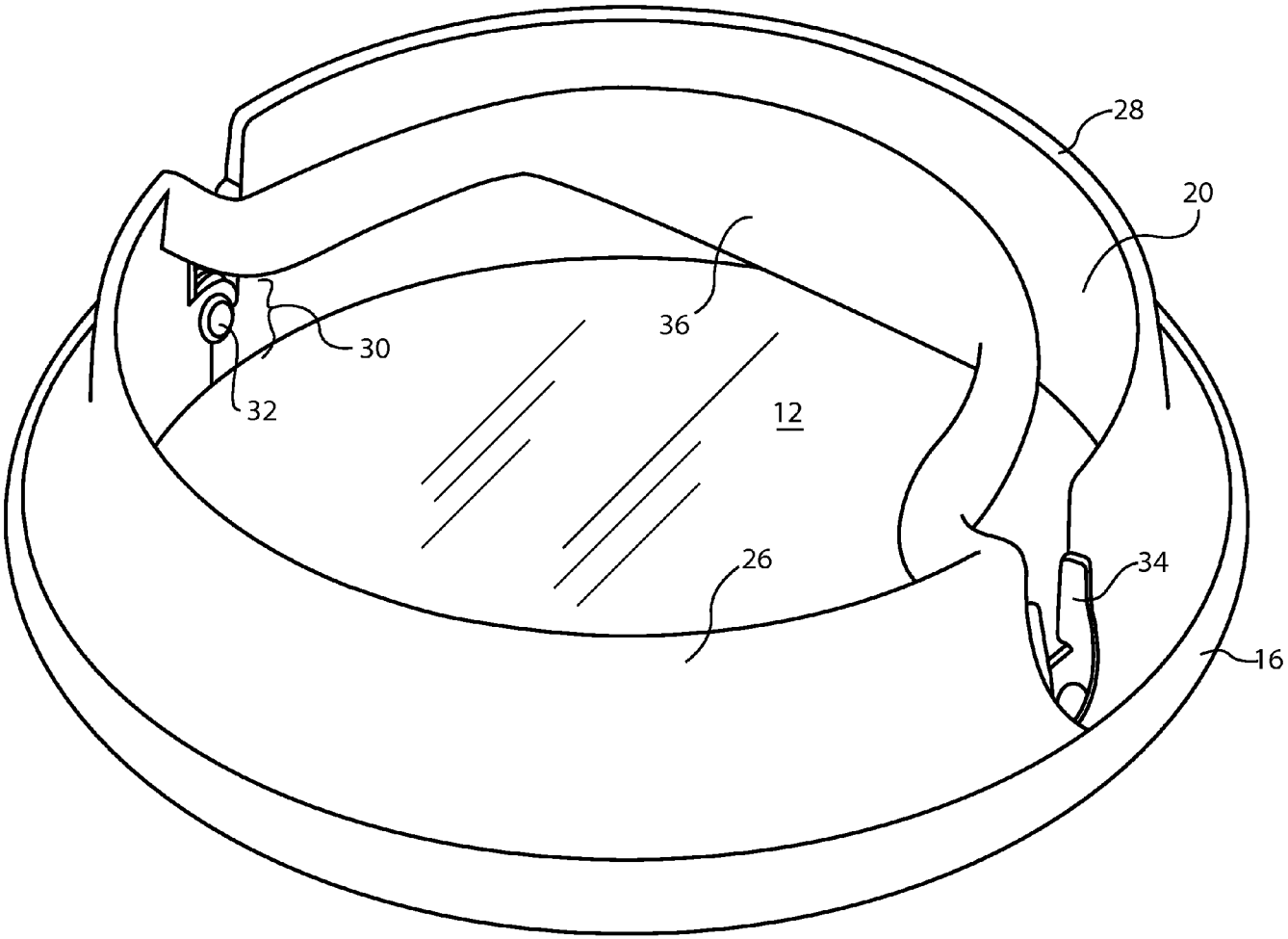
FIG. 3 is a bottom perspective view of the embodiment of FIG. 1.

Referring to FIG. 1 in conjunction with both FIG. 2 and FIG. 3, a hand drum assembly 10 is shown. The hand drum assembly 10 has a synthetic striking membrane 12. The striking membrane 12 is placed over an annular body 14 and is held in place by a ring collar 16. The ring collar 16 is affixed to the annular body 14 with adhesive, a mechanical crimp and/or a heat weld. Accordingly, it will be understood that the striking membrane 12 is held in place by having its periphery pinched between the ring collar 16 and the annular body 14.

The annular body 14 has an open top 18 and an open bottom 19 that are defined internally within the annular body 14 by a cylindrical wall 20. A rim protrusion 22 radially extends from the exterior of the cylindrical wall 20 near the open top 18. The rim protrusion 22 provides the surface area needed to affix the ring collar 16 to the annular body 14 and pinch the periphery of the striking membrane 12 firmly between the annular body 14 and the ring collar 16.

Two reliefs 24 are present in the cylindrical wall 20. The two reliefs 24 are present on directly opposite sides of the cylindrical wall 20. Accordingly, the annular body 14 can be considered to have two sections. A first section 26 is located on one side of the two reliefs 24 and a second section 28 is located on the opposite side. The first section 26 and the second section 28 of the annular body 14 are mirror images of each other.

The presence of the reliefs 24 in the cylindrical wall 20 creates opposing narrow regions in the structure of the annular body 14. These narrowed regions are herein referred to as bending regions 30 because it is easier for the annular body 14 to bend in these narrow regions than in any other region.

In the embodiment of FIGS. 1-3, the first section 26 and the second section 28 of the annular body 14 are separate pieces that are joined together in the bending regions 30 with a hinge connection 32. Since the first section 26 and the second section 28 of the annular body 14 are joined together at hinge connections 32, it will be understood that the open top 18 of the annular body 14 need not exist in a single plane. Rather, the top of the first section 26 can be inclined at an angle relative to the top of the second section 28 and vice-versa.

Spring clips 34 are provided that rest in the reliefs 24 between the first section 26 and the second section 28 of the annular body 14. The spring clips 34 bias the first section 26 and the second section 28 of the annular body 14 so that the open top 18 of the annular body 14 extends in a single common plane across the top of both sections.

Figure 4:
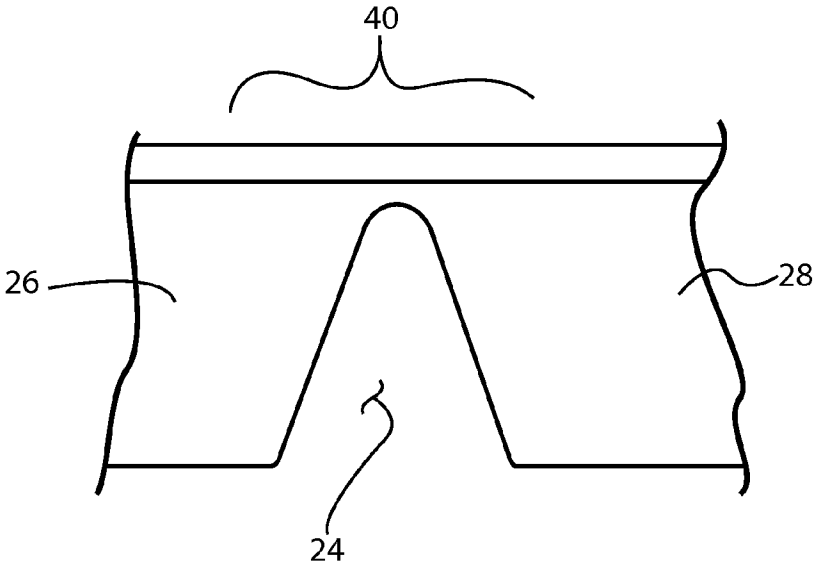
FIG. 4 is a fragmented view of an alternate embodiment of a bending region within the annular body.

Referring briefly to FIG. 4, an alternate configuration for a bending region 40 is shown. In this embodiment, the first section 26 and the second section 28 of the annular body 14 are molded together as a single piece of plastic. The presence of the relief 24 in the cylindrical wall 20 creates the thinned bending region 40. Because the bending region 40 is thinned, it enables the annular body 14 to bend. However, the stiffness of the plastic is sufficient to hold the first and second sections 26, 28 in position so that they share a common top plane.

Returning to FIG. 2 and FIG. 3, it can be seen that a lever arm 36 is attached to the first section 26 of the annular body 14. The lever arm 36 extends inwardly into the interior of the hand drum assembly 10 so that it can be easily touched by the fingers of a person holding the hand drum assembly 10. The lever arm 36 attaches to the annular body 14 near the open bottom 19 of the first section 26. It will therefore be understood that when the lever arm 36 is pushed or pulled by the fingers of a person holding the hand drum assembly 10, the lever arm 36 creates a bending torque in the first section 26 of the hand drum assembly 10. The bending torque causes the annular body 14 to bend slightly in the bending regions 30. If the first section 26 is caused to bend upwardly, the tautness of the striking membrane 12 deceases slightly. This reduces the tone of the hand drum assembly 10. Conversely, if the first section 26 of the annular body 14 is caused to bend downwardly, the tautness of the striking membrane 12 increases. This increases the tone of the hand drum assembly 10.

It will therefore be understood that a person holding the hand drum assembly 10 can manipulate the lever arm 36 while they are striking the hand drum assembly 10. The tone of the hand drum assembly 10 can be actively controlled while the hand drum assembly 10 is being played. This enables the hand drum assembly 10 to achieve different notes during play, which is unique for a percussion instrument.

Figure 5:
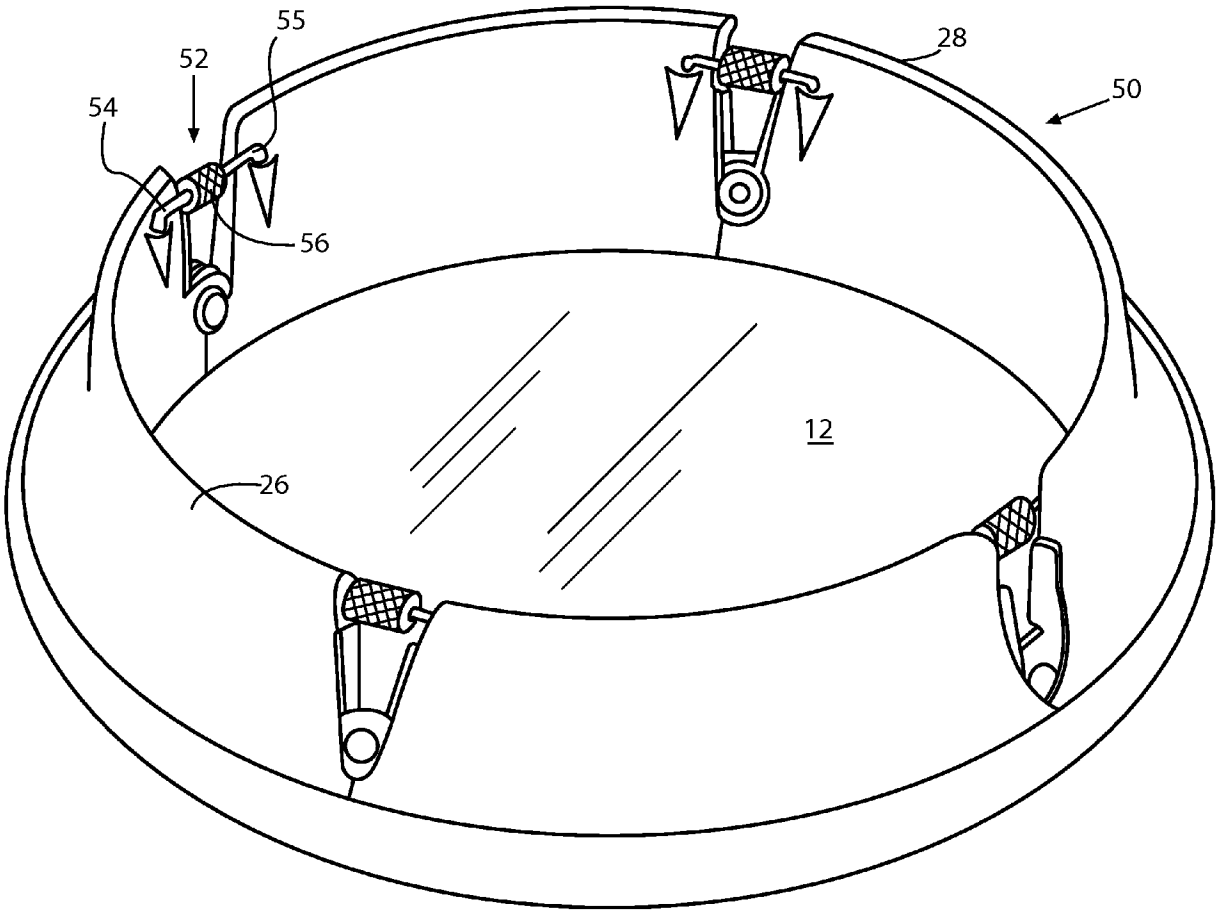
FIG. 5 is a bottom perspective view of an alternate embodiment of a hand drum assembly.

The use of a lever arm 36 enables the tone of the hand drum assembly 10 to be selectively altered during play. However, once the lever arm 36 is released, the hand drum assembly 10 automatically reverts back to its original tone. In order to create more permanent changes to the tone of the hand drum assembly 10, other adjustment mechanisms can be used either in place of the lever arm 36 or in conjunction with the lever arm 36. Referring now to FIG. 5, one such alternate embodiment for an adjustment mechanism is shown.

In FIG. 5, a hand drum assembly 50 is shown having an annular body 14 and striking membrane 12 having a construction similar to that which has previously been described. In this embodiment, the annular body 14 has been divided into four sections 60, 61, 62, 63 that are divided by reliefs 24. Spanners 52 have been added to the hand drum assembly 50 in between each of the four sections 60, 61, 62, 63. Each spanner 52 consists of two arms 54, 55 that thread into an adjustment nut 56. When the adjustment nut 56 is turned, the arms 54, 55 are either pulled toward each other or pushed apart. The ends of the arms 54, 55 engage opposite sections of the annular body 14. That is, the first arm 54 engages a first section of the annular body 14 and the second arm engages a second adjacent section of the annular body 14. In this manner, when the adjustment nut 56 is turned, the spanners 52 either spread the relief 24 more open or pull the relief 24 more closed. This force causes the bending region 30 to bend, thereby either increasing or decreasing the tautness of the striking membrane 12. It will therefore be understood that the spanners 52 can be used to selectively tune the hand drum assembly prior to its use in making music.

It will be understood that the embodiments of the present invention that are illustrated and described are merely exemplary and that a person skilled in the art can make many variations to those embodiments using functionally equivalent components. For instance, the lever arm can have many configurations. Likewise, many mechanical clamps and spreaders can be used in place of the spanners illustrated. Furthermore, it will be understood that the shape of the drum and the manner in which the striking membrane is retained can be altered. It will also be understood that the body of the drum can be divided into any plurality of sections. All such variations, modifications and alternate embodiments are intended to be included within the scope of the present invention as defined by the claims.

What is claimed is:

1. A percussion instrument, comprising:

an annular body integrally formed as a single molded form, said annular body having an open top, an open bottom, a cylindrical wall that extends from said open bottom toward said open top, and two reliefs that are disposed on opposites sides of said cylindrical wall wherein said reliefs create bending regions in said annular body that divide said annular body between a first section on one side of said bending regions and a second section opposite said first section;

a striking membrane placed over said open top of said annular body;

a collar for attaching said striking membrane to said annular body with a predetermined tautness; and an adjustment mechanism for selectively bending said annular body within said bending regions, therein selectively altering said tautness of said striking membrane.

2. The instrument according to claim 1, wherein said first section and said second section of said annular body are joined at hinge connections within said bending regions.

3. The instrument according to claim 1, further including spring clips disposed within said reliefs.

4. The instrument according to claim 1, wherein said adjustment mechanism includes a lever arm coupled to said first section of said annular body, wherein said lever arm causes said annular body to slightly bend in said bending regions when a force is manually applied to said lever arm.

5. The instrument according to claim 1, wherein said adjustable mechanism includes at least one adjustable spanner that has a first end coupled to said first section of said annular body and a second end coupled to said second section of said annular housing.

6. A method of altering the tone of a drum, comprising the steps of:

providing a drum with an annular body having a first section and a second section joined by hinge connections in bending rejoins, said drum having a striking membrane placed over an annular body, wherein said striking membrane has a predetermined tautness that determines a tone for said drum;

selectively bending said annular body about said bending regions, therein selectively increasing or decreasing said tautness of said striking membrane.

7. The method according to claim 6, wherein said step of selectively bending said annular body includes providing a lever arm that extends into annular body and applying manual force to said lever arm.

8. The method according to claim 6, wherein said step of selectively bending said annular body includes providing a plurality of spanners, wherein each spanner can be selectively altered in length and engages said annular body on opposite sides of each of said bending regions.

9. A hand drum instrument, comprising:

an annular body having a plurality of sections that include a first section and a second section, wherein said first section and said second section are joined at bending regions;

a striking membrane supported by said annular body, wherein said striking membrane has a predetermined tautness that determines a tone for said hand drum;

a lever arm coupled to said first section of said annular body , said lever arm causing said annular body to slightly bend in said bending regions when a force is manually applied to said lever arm, thereby altering said tautness and said tone of said hand drum.

10. The instrument according to claim 9, wherein said first section and said second section of said annular body are joined at hinge connections within said bending regions.

11. The instrument according to claim 9, wherein said first section and said second section of said annular body are integrally formed as a single molded form, wherein said annular body thins in said bending regions to enable said annular body to deform in said bending regions when stressed by said adjustment mechanism.

12. The instrument according to claim 9, wherein said adjustable mechanism includes at least one adjustable spanner that has a first end coupled to said first section of said annular body and a second end coupled to said second section of said annular body.

* * * * *